US008264418B2

(12) United States Patent
Huang

(10) Patent No.: US 8,264,418 B2
(45) Date of Patent: Sep. 11, 2012

(54) PLANAR ANTENNA WITH ISOTROPIC RADIATION PATTERN

(75) Inventor: Huan-Chu Huang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 394 days.

(21) Appl. No.: 12/619,689

(22) Filed: Nov. 17, 2009

(65) Prior Publication Data

US 2011/0037673 A1 Feb. 17, 2011

(30) Foreign Application Priority Data

Aug. 14, 2009 (TW) ..... 98127503 A

(51) Int. Cl.
*H01Q 9/16* (2006.01)

(52) U.S. Cl. ..... 343/793; 343/895; 343/700 MS

(58) Field of Classification Search ..... None
See application file for complete search history.

(56) References Cited

U.S. PATENT DOCUMENTS

| | | | | |
|---|---|---|---|---|
| 7,586,462 | B1 | 9/2009 | Tetorka | |
| 7,619,565 | B2 * | 11/2009 | Chen et al. | 343/700 MS |
| 2006/0208900 | A1 | 9/2006 | Hozouri | |
| 2011/0012805 | A1 * | 1/2011 | Huang | 343/833 |

FOREIGN PATENT DOCUMENTS

| | | |
|---|---|---|
| EP | 1498982 | 1/2005 |
| WO | 2008009667 | 1/2008 |

OTHER PUBLICATIONS

"Search Report of European Counterpart Application" issued on Mar. 2, 2010, p. 1-p. 3.
"Office Action of European Counterpart Application" issued on Mar. 16, 2010, p. 1-p. 3.

* cited by examiner

*Primary Examiner* — Trinh Dinh
(74) *Attorney, Agent, or Firm* — Jianq Chyun IP Office

(57) ABSTRACT

A planar antenna with an isotropic radiation pattern is provided. The planar antenna includes a substrate, a dipole antenna, a microstrip line set, and a channel selection module. The dipole antenna is disposed on a first surface of the substrate, and the microstrip line set and the channel selection module are disposed on a second surface of the substrate. A first microstrip line and a second microstrip line of the microstrip line set are spirally extended along two opposite rotation trails on a vertical projection plane to form a high-frequency path with the dipole antenna. The planar antenna controls the on/off state of the channel selection module so that a low-frequency path is formed when the dipole antenna is connected to a first line and a second line. A plurality of channels having different operating frequencies is respectively generated within the high-frequency path and the low-frequency path.

13 Claims, 6 Drawing Sheets

PLANAR ANTENNA WITH ISOTROPIC RADIATION PATTERN

CROSS-REFERENCE TO RELATED APPLICATION

This application claims the priority benefit of Taiwan application serial No. 98127503, filed on Aug. 14, 2009. The entirety of the above-mentioned patent application is hereby incorporated by reference herein and made a part of this specification.

BACKGROUND OF THE INVENTION

1. Field of the Invention

The present invention generally relates to a planar antenna, and more particularly, to a planar antenna with an isotropic radiation pattern.

2. Description of Related Art

The isotropic radiation pattern can prevent deterioration of communication quality caused by nulls. Thus, antennas with the isotropic radiation pattern are very adaptable to communication products, especially handheld products (for example, cell phones, notebook computers, portable mobile communication devices, Bluetooth devices, or WiFi devices), for receiving or transmitting wireless signals from or to all directions. FIG. 1 illustrates the structure of a conventional antenna with the isotropic radiation pattern. Referring to FIG. 1, the antenna 100 includes a substrate 110, a dipole antenna 120, a spiral radiating body 130, and another spiral radiating body 140. The dipole antenna 120 is disposed on a first surface 111 of the substrate 110, and the spiral radiating bodies 130 and 140 are respectively disposed on a second surface of the substrate 110. For the convenience of description, the corresponding positions of the spiral radiating bodies 130 and 140 on the first surface 111 of the substrate 110 are perspectively denoted with doted lines.

Referring to FIG. 1, the spiral radiating bodies 130 and 140 are symmetrical to each other and electrically connected to two radiating bodies 121 and 122 in the dipole antenna 120 respectively through a via 151 and a via 152. Based on the Ampere's right-hand rule, the magnetic fields produced by the spiral radiating bodies 130 and 140 run through the first surface 111 (i.e., the magnetic field directions M12 and M13) with the current direction D11 and form a magnetic dipole. Besides, the direction of the magnetic dipoles produced by the spiral radiating bodies 130 and 140 is perpendicular to that of the electric dipole produced by the dipole antenna 120. Thus, the antenna 100 can generate two orthogonal radiation patterns through the spiral radiating bodies 130 and 140 and the dipole antenna 120 and accordingly produce the isotropic radiation pattern due to the mutual compensation of the two orthogonal radiation patterns.

To be specific, the spiral radiating body 130 is composed of three microstrip lines 131~133 that are connected with each other in series. The microstrip line 132 presents a narrow arc shape (for example, a narrow transmission line) therefore can relatively block high-frequency signals. The impedance X of the microstrip line 132 satisfies $X=\omega L=(2\pi f)L$, therefore the impedance X is in direct proportion to the frequency f and the inductance value L, which means the higher the frequency f or inductance L is, the greater the impedance X will be and accordingly the harder for high-frequency signals to pass through, wherein the length of the micro strip line 132 should be shorter than $\lambda_g/4$ wherein $\lambda_g$ is a guided wavelength. In other words, the microstrip line 132 is like an inductive filter, wherein the low-frequency signals from the microstrip line 131 can pass through the microstrip line 132 and reach the microstrip line 133, but the high-frequency signals from the microstrip line 131 cannot pass through the microstrip line 132. Accordingly, a high-frequency path is formed by the radiating body 121 and the microstrip line 131 that are connected with each other in series, and a low-frequency path is formed by the radiating body 121 and the microstrip lines 131~133 that are connected with each other in series. Thereby, the antenna 100 with the isotropic radiation pattern can receive and transmit dual band signals.

Besides, the narrower width of the microstrip line 132 is, the higher inductance value L and hence the better blocking ability of the high-frequency will be. However, it should be noted that because the minimum width of the microstrip line 132 is limited by the printing technique on the substrate 110, the capability of blocking high-frequency signals is thus also limited by the printing technique on the substrate 110. In addition, if the microstrip line 132 is disposed at a fixed position, the antenna 100 with the isotropic radiation pattern can only be applied to limited types of channels (i.e., channel selection cannot be carried out) within the high and low frequency paths. Moreover, due to the narrow width of the microstrip line 132 with large inductance value L to do better blockage of high-frequency signals, the energy loss will hence increase. In other words, the radiation efficiency of the isotropic antenna 100 is reduced.

SUMMARY OF THE INVENTION

Accordingly, the present invention is directed to a planar antenna with an isotropic radiation pattern, wherein a microstrip line set and a dipole antenna are electrically connected with each other to form a high-frequency path, and the on/off state of a channel selection element is controlled so that a high-frequency path and a low-frequency path having different operating frequencies are generated when the dipole antenna is connected to a first line and a second line, so as to obtain different communication channels within different high-frequency bands and low-frequency bands.

The present invention provides a planar antenna with an isotropic radiation pattern. The planar antenna includes a substrate, a dipole antenna, a microstrip line set, and a channel selection element. The dipole antenna is disposed on a first surface of the substrate, and the microstrip line set and the channel selection element are disposed on a second surface of the substrate. The dipole antenna has a first radiating body and a second radiating body. A first microstrip line and a second microstrip line of the microstrip line set are spirally extended along two opposite rotation trails (clockwise and counterclockwise) on a vertical projection plane respectively with the ends of the first radiating body and the second radiating body as the starting points, so as to form a high-frequency path with the dipole antenna. The channel selection element is electrically connected to the microstrip line set, a first line, and a second line. The planar antenna with the isotropic radiation pattern controls the on/off state of the channel selection element so that a low-frequency path is formed when the dipole antenna is connected to the first line and the second line. A plurality of channels having different operating frequencies is respectively generated within the high-frequency path and the low-frequency path.

According to an embodiment of the present invention, the channel selection element includes a plurality of first channel units and a plurality of second channel units. The first channel units are electrically connected between the first microstrip line and the first line, and the second channel units are electrically connected between the second microstrip line and the second line. Besides, the planar antenna with the isotropic radiation pattern correspondingly controls the on/off states of the first channel units and the second channel units to selectively switch to one of the channels within the high-frequency path and the low-frequency path.

According to an embodiment of the present invention, the channel selection module includes a plurality of first channel units and a plurality of second channel units. The first channel units are electrically connected between the first microstrip line and the first line, and the second channel units are electrically connected between the second microstrip line and the second line. Besides, the planar antenna with the isotropic radiation pattern correspondingly controls the on/off states of the first channel units and the second channel units to selectively switch to one of the channels within the high-frequency path and the low-frequency path.

According to an embodiment of the present invention, each of the first channel units includes a first switch and a first inductor, wherein a first end of the first switch is electrically connected to the first microstrip line, a first end of the first inductor is electrically connected to a second end of the first switch, and a second end of the first inductor is electrically connected to the first line.

According to an embodiment of the present invention, each of the second channel units includes a second switch and a second inductor, wherein a first end of the second switch is electrically connected to the second microstrip line, a first end of the second inductor is electrically connected to a second end of the second switch, and a second end of the second inductor is electrically connected to the second line.

According to an embodiment of the present invention, the first microstrip line and the second microstrip line are spirally extended inwards or outwards respectively along the two opposite rotation trails on the vertical projection plane, so as to surround the first radiating body and the second radiating body.

As described above, in the present invention, an isotropic radiation pattern is produced through a magnetic dipole formed by the microstrip line set and an electric dipole fonned by the dipole antenna. In addition, in the present invention, a high-frequency path is formed by using the microstrip line set and the dipole antenna that are electrically connected with each other, and the on/off state of the channel selection element is controlled so that a plurality of high-frequency paths and a plurality of low-frequency paths having different operating frequencies are respectively generated when the dipole antenna is connected to a first line and a second line. Besides, compared to the conventional technique, the planar antenna with the isotropic radiation pattern in the present invention has reduced size and improved radiation efficiency due to the less energy loss in the narrow microstip lines. Moreover, the planar antenna with the isotropic radiation pattern in the present invention can receive or transmit signals through different channels within different high- and low-frequency bands by switching between channel units in the channel selection element.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
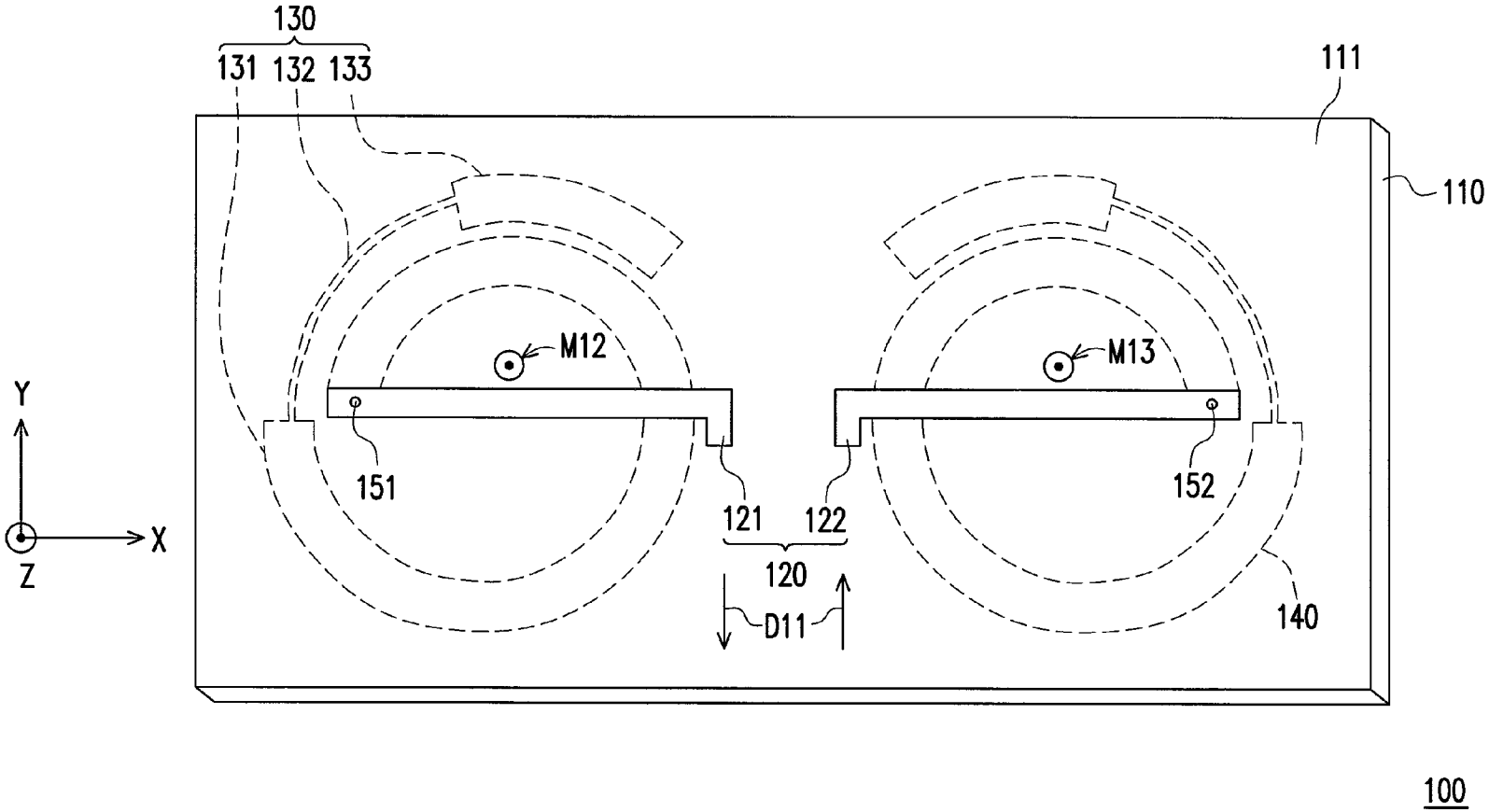
FIG. 1 (PRIOR ART)
FIG. 1 illustrates the structure of a conventional antenna with an isotropic radiation pattern.

Reference will now be made in detail to the present preferred embodiments of the invention, examples of which are illustrated in the accompanying drawings. Wherever possible, the same reference numbers are used in the drawings and the description to refer to the same or like parts.

Figure 2:
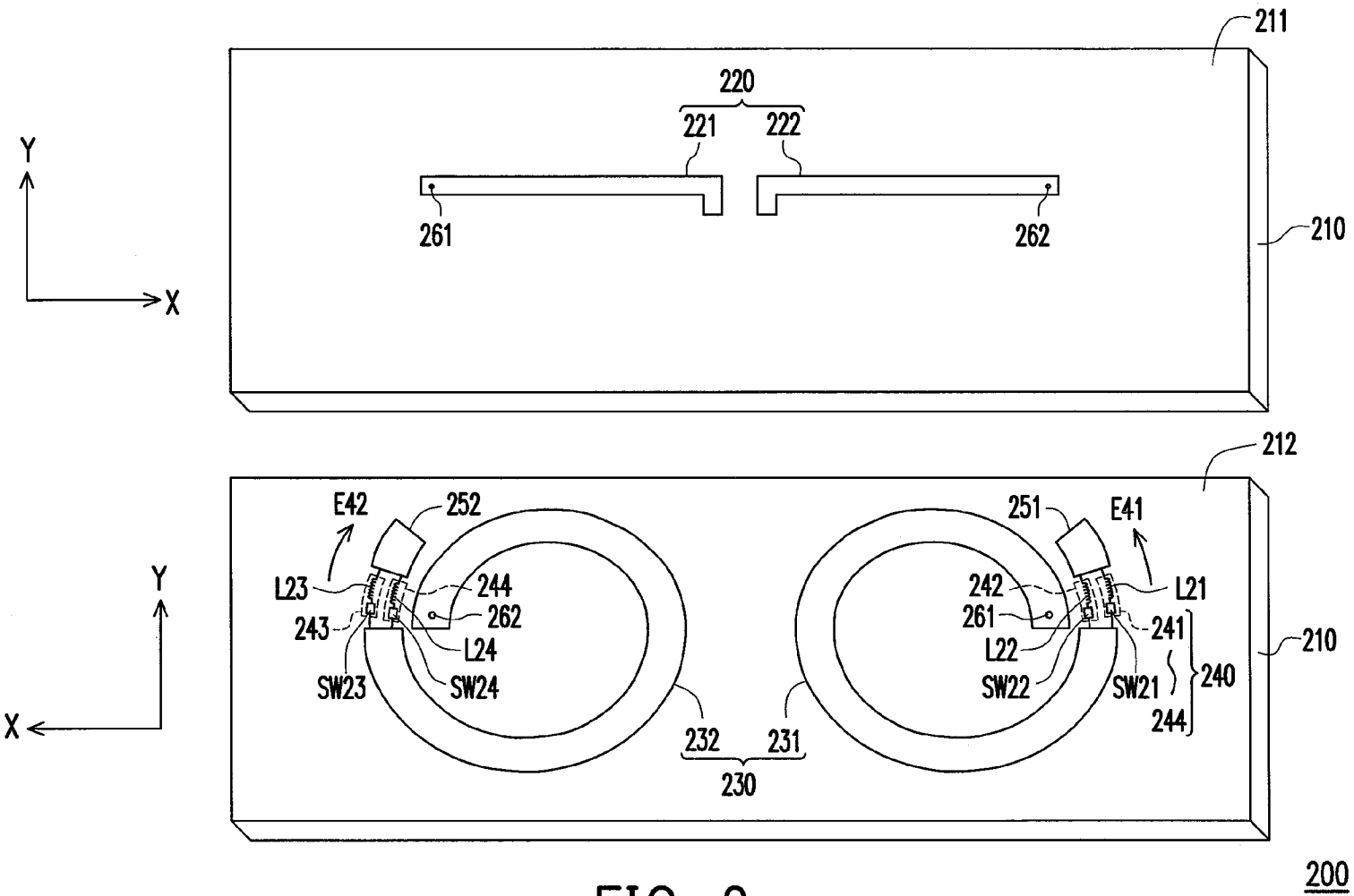
FIG. 2 illustrates the structure of a planar antenna with an isotropic radiation pattern according to an embodiment of the present invention.

FIG. 2 illustrates the structure of a planar antenna with an isotropic radiation pattern according to an embodiment of the present invention. Referring to FIG. 2, the planar antenna 200 includes a substrate 210, a dipole antenna 220, a microstrip line set 230, a channel selection element 240, a first line 251, and a second line 252. The substrate 210 has a first surface 211 (i.e., a plane fonned by the axis X and the axis Y) and a second surface 212 (i.e., a plane formed by the axis X and the axis Y).

The dipole antenna 220 has a first radiating body 221 and a second radiating body 222. The first radiating body 221 and the second radiating body 222 are symmetrical to each other and are disposed on the first surface 211 of the substrate 210. On the other hand, the microstrip line set 230, the channel selection element 240, the first line 251, and the second line 252 are disposed on the second surface 212 of the substrate 210.

Figure 3:
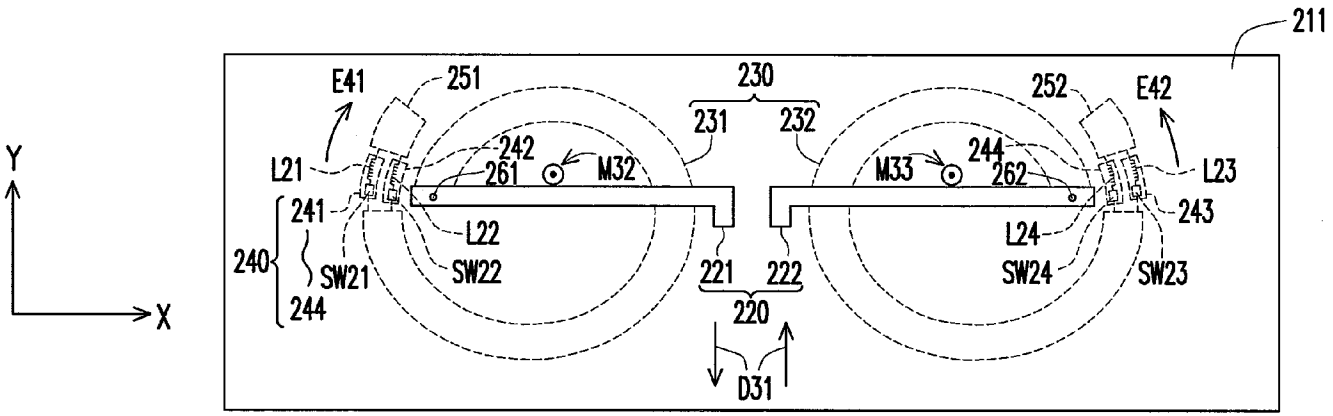
FIG. 3 is a perspective view of the planar antenna in FIG. 2 on a vertical projection plane.

FIG. 3 is a perspective view of the planar antenna 200 in FIG. 2 on a vertical projection plane, wherein the corresponding positions of the microstrip line set 230, the channel selection element 240, the first line 251, and the second line 252 vertically projected onto the first surface 211 are denoted with dotted lines.

Referring to both FIG. 2 and FIG. 3, the microstrip line set 230 includes a first microstrip line 231 and a second microstrip line 232. The first microstrip line 231 is electrically connected to the first radiating body 221 through a first via 261, and the second microstrip line 232 is electrically connected to the second radiating body 222 through a second via 262. Regarding the actual disposition, as shown in FIG. 3, the first microstrip line 231 is spirally extended outwards from the end of the first radiating body 221 along a clockwise rotation trail, so as to surround the first radiating body 221. Besides, the second microstrip line 232 is spirally extended outwards from the end of the second radiating body 222 along an anticlockwise rotation trail, so as to surround the second radiating body 222.

Generally speaking, the first microstrip line 231 and the second microstrip line 232 are spirally extended along two opposite rotation trails, and at the same time, the first microstrip line 231 and the second microstrip line 232 partially overlap the first radiating body 221 and the second radiating body 222 on the vertical projection plane. Namely, the first radiating body 221 and the second radiating body 222 exceed the vertical projection range of the first microstrip line 231 and the second microstrip line 232. Besides, the first microstrip line 231 and the second microstrip line 232 may also be extended in a symmetrical or asymmetrical way. Accordingly, with the current direction D31, the magnetic field produced by the first microstrip line 231 runs through the first surface 211 of the substrate 210 (i.e., the magnetic field direction M32), and the magnetic field produced by the second microstrip line 232 also runs through the first surface 211 of the substrate 210 (i.e., the magnetic field direction M33). Thus, the first microstrip line 231 and the second microstrip line 232 form a pair of in-phase magnetic dipoles, and the magnetic dipoles are perpendicular to the electric dipole produced by the dipole antenna 220. Thereby, the planar antenna 200 can produce two orthogonal radiation components through the dipole antenna 120 and the microstrip line set 230, so as to achieve the isotropic radiation pattern.

Referring to FIG. 2 and FIG. 3 again, the channel selection element 240 includes a plurality of first channel units 241~242 and a plurality of second channel units 243~244, wherein each of the channel units 241~244 includes an inductor and a switch. For example, the first channel unit 241 includes a inductor L21 and a switch SW21, wherein a first end of the switch SW21 is electrically connected to the first microstrip line 231, a first end of the inductor L21 is electrically connected to a second end of the switch SW21, and a second end of the inductor L21 is electrically connected to the first line 251.

Similarly, the first channel unit 242 includes a inductor L22 and a switch SW22, wherein a first end of the switch SW22 is electrically connected to the first microstrip line 231, a first end of the inductor L22 is electrically connected to a second end of the switch SW22, and a second end of the inductor L22 is electrically connected to the first line 251. On the other hand, the second channel unit 243 includes an inductor L23 and a switch SW23, wherein the switch SW23 and the inductor L23 are connected in series between the second microstrip line 232 and the second line 252. The second channel unit 244 includes an inductor L24 and a switch SW24, wherein the switch SW24 and the inductor L24 are connected in series between the second microstrip line 232 and the second line 252.

To be specific, the switch SW21 and the inductor L21 in the first channel unit 241 are connected with each other in series along a first extension direction E41 of the first microstrip line 231, and the switch SW22 and the inductor L22 in the first channel unit 242 are also connected with each other in series along the first extension direction E41 of the first microstrip line 231. Besides, the first channel units 241 and 242 are arranged in parallel along the first extension direction E41, and the first line 251 is connected with the first channel units 241-242 in series along the first extension direction E41.

On the other hand, the switch SW23 and the inductor L23 in the second channel unit 243 are connected with each other in series along a second extension direction E42 of the second microstrip line 232, and the switch SW24 and the inductor L24 in the second channel unit 244 are connected with each other in series along the second extension direction E42 of the second microstrip line 232. Besides, the second channel units 243 and 244 are arranged in parallel along the second extension direction E42, and the second line 252 is connected with the second channel units 243~244 in series along the second extension direction E42.

The impedance X of the inductors L21~L24 satisfies $X=\omega\times L=L=(2\pi f)\times L$ in the overall interaction. Namely, the impedance X of the inductors L21~L24 is in direct proportion to the frequency f and inductance value L. Accordingly, along with the increase of the frequency f, the impedance X of the inductors L21~L24 also increases so that the inductors L21~L24 can achieve a function of blocking high-frequency signals (i.e., a screening function). Namely, each of the inductors L21~L24 is equivalent to a filter. Low-frequency signals from the microstrip line set 230 can pass through the inductors L21~L24 to reach the first line 251 and the second line 252, while high-frequency signals from the microstrip line set 230 cannot pass through the inductors L21~L24.

Thereby, as shown in FIG. 3, when the switches SW21 and SW23 are turned on and the switches SW22 and SW24 are turned off, as to the elements at the left portion of the planar antenna 200 with the isotropic radiation pattern, the current path formed by the first radiating body 221 and the first microstrip line 231 forms a high-frequency path, and the current path formed by the first radiating body 221, the first microstrip line 231, the switch SW21, the inductor L21, and the first line 251 forms a low-frequency path. Similarly, as to the elements at the right portion of the planar antenna 200 with the isotropic radiation pattern, the current path formed by the second radiating body 222 and the second microstrip line 232 forms a high-frequency path, and the current path formed by the second radiating body 222, the second microstrip line 232, the switch SW23, the inductor L23, and the second line 252 forms a low-frequency path.

In other words, when the switches SW21 and SW23 are turned on and the switches SW22 and SW24 are turned off, the planar antenna 200 with the isotropic radiation pattern can receive and transmit dual band signals, namely, signals from a high-frequency band and a low-frequency band. It should be noted that if the high-frequency band and low-frequency band adopted by the planar antenna 200 with the isotropic radiation pattern respectively include a plurality of channels having different operating frequencies, in the present invention, only a high-frequency channel, a medium-frequency channel, and a low-frequency channel are taken as examples for the convenience of description. In this case, the planar antenna 200 with the isotropic radiation pattern can receive and transmit signals through each low-frequency channel within the high-frequency band and low-frequency band because the longest current path is formed.

On the other hand, as shown in FIG. 3, when the switches SW21 and SW23 are turned off and the switches SW22 and SW24 are turned on, as to the elements at the left portion of the planar antenna 200 with the isotropic radiation pattern, the low-frequency path of the planar antenna 200 is switched to a current path formed by the first radiating body 221, the first microstrip line 231, the switch SW22, the inductor L22, and the first line 251. Similarly, as to the elements at the right portion of the planar antenna 200 with the isotropic radiation pattern, the low-frequency path of the planar antenna 200 is switched to a current path formed by the second radiating body 222, the second microstrip line 232, the switch SW24, the inductor L24, and the second line 252.

It should be mentioned that the low-frequency path formed by the inductor L21 and the inductor L23 cause the currents in the first microstrip line 231 and the second microstrip line 232 to flow along the outer edges of the microstrip lines. On the other hand, the low-frequency path formed by the inductor L22 and the inductor L24 cause the currents in the first microstrip line 231 and the second microstrip line 232 to flow along the inner edges of the microstrip lines. Thus, when the switches SW21 and SW23 are turned off and the switches SW22 and SW24 are turned on, the low-frequency path is relatively shortened. In other words, the low-frequency channels within the high-frequency band and low-frequency band originally adopted by the planar antenna 200 with the isotropic radiation pattern are all switched to high-frequency channels because the shortest current path is formed.

Besides, as shown in FIG. 3, when the switches SW21~SW24 are all turned on, as to the elements at the left portion of the planar antenna 200 with the isotropic radiation pattern, the low-frequency path of the planar antenna 200 is formed by the inductor L21 and the inductor L22, and as to the elements at the right portion of the planar antenna 200 with the isotropic radiation pattern, the low-frequency path of the planar antenna 200 is formed by the inductor L23 and the inductor L24. In this case, the currents in the first microstrip line 231 and the second microstrip line 232 flow evenly, so that the low-frequency channels within the high-frequency band and low-frequency band originally adopted by the planar antenna 200 with the isotropic radiation pattern are all switched to medium-frequency channels.

Moreover, as shown in FIG. 3, when the switches SW21~SW24 are all turned off, the planar antenna 200 with the isotropic radiation pattern cannot receive or transmit signals in the low-frequency band but can only constantly receive and transmit signals in the high-frequency band. Such a special situation is usually caused by the configuration of a single-band) access point or basestation, such as an access point or a basestation for providing a high-frequency band. In other words, by switching the on/off state of the channel selection element 240, a plurality of high-frequency paths and low-frequency paths having different operating frequencies is generated when the dipole antenna 220 is connected to the first line 251 and the second line 252. Thus, the planar antenna 200 with the isotropic radiation pattern can selectively switch channels within the high-frequency paths and low-frequency paths by correspondingly controlling the on/off state of each switch in the first channel units 241~242 and the second channel units 243~244 (i.e., the planar antenna 200 achieves a frequency selection function) to correspond to different channel within the high-frequency band and low-frequency band.

Besides, the sizes or inductance values of the inductors L21~L24 in the channel units 241~244 are not restricted by the printing technique on the substrate 210, so that the capability of blocking high-frequency signals can be improved.

It should be noted that the pattern of that the microstrip line set 230 in the planar antenna 200 with the isotropic radiation pattern surrounds the radiating bodies 221 and 222 can be adjusted according to the actual design requirement. Besides, the disposed positions of the channel selection element 240, the first line 251, and the second line 252 can also be changed along with the pattern of that the microstrip line set 230 surrounds the radiating bodies 221 and 222. Some possible implementations of the planar antenna with the isotropic radiation pattern will be described below in order to allow those having ordinary knowledge in the art to better understand the present invention.

Figure 4:
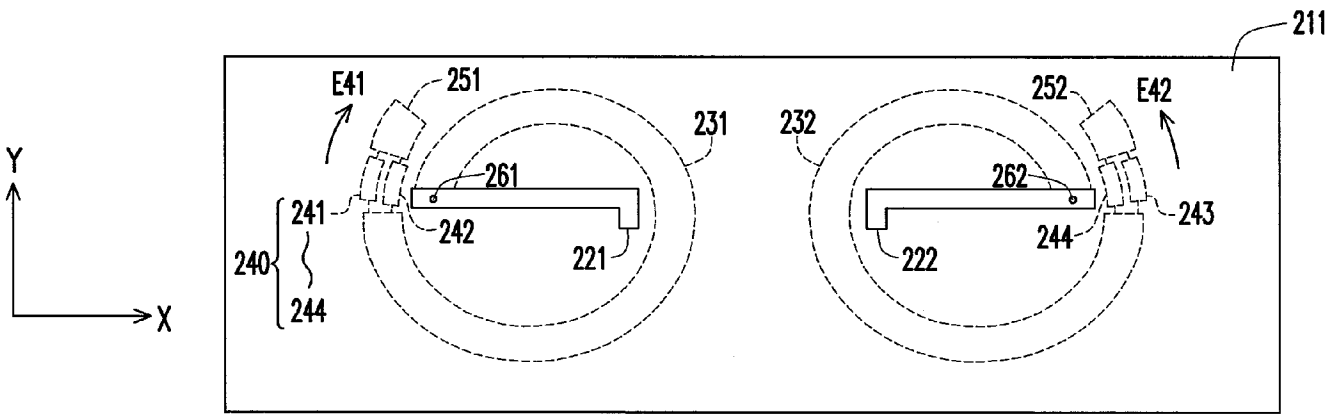
FIG. 4 is a perspective view of a planar antenna with an isotropic radiation pattern on a vertical projection plane according to another embodiment of the present invention.

FIG. 4 is a perspective view of a planar antenna with an isotropic radiation pattern on a vertical projection plane according to another embodiment of the present invention. Referring to both FIG. 4 and FIG. 3, in the present embodiment, the first microstrip line 231 and the second microstrip line 232 are spirally extended along two opposite rotation trails, and at the same time, the first microstrip line 231 and the second microstrip line 232 respectively surround the first radiating body 221 and the second radiating body 222 on the vertical projection plane. In particular, the first radiating body 221 and the second radiating body 222 do not exceed the vertical projection range of the first microstrip line 231 and the second microstrip line 232.

Figure 5:
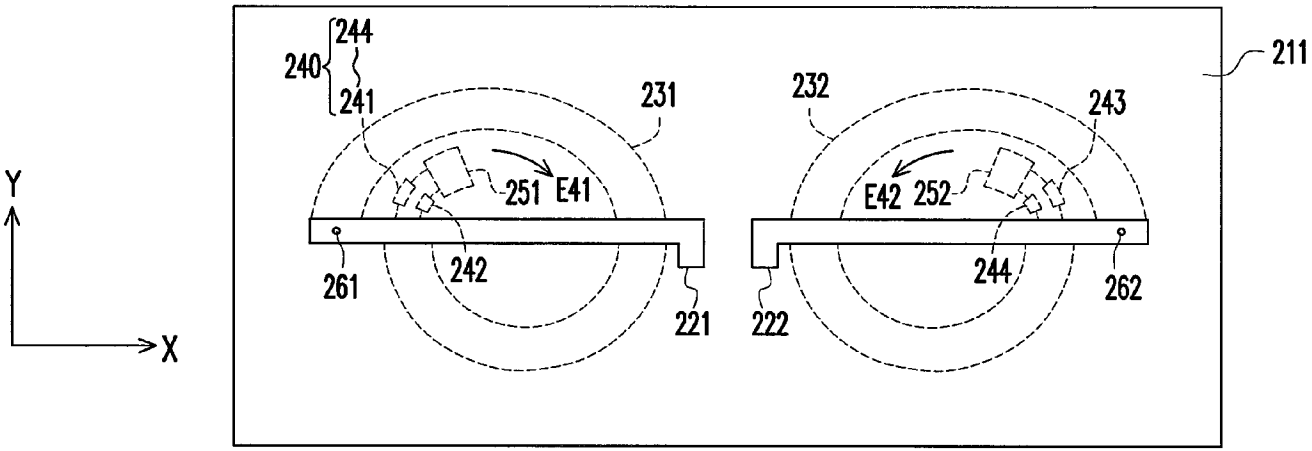
FIG. 5 and FIG. 6 are respectively a perspective view of a planar antenna with an isotropic radiation pattern on a vertical projection plane according to yet another embodiment of the present invention.
Figure 6:
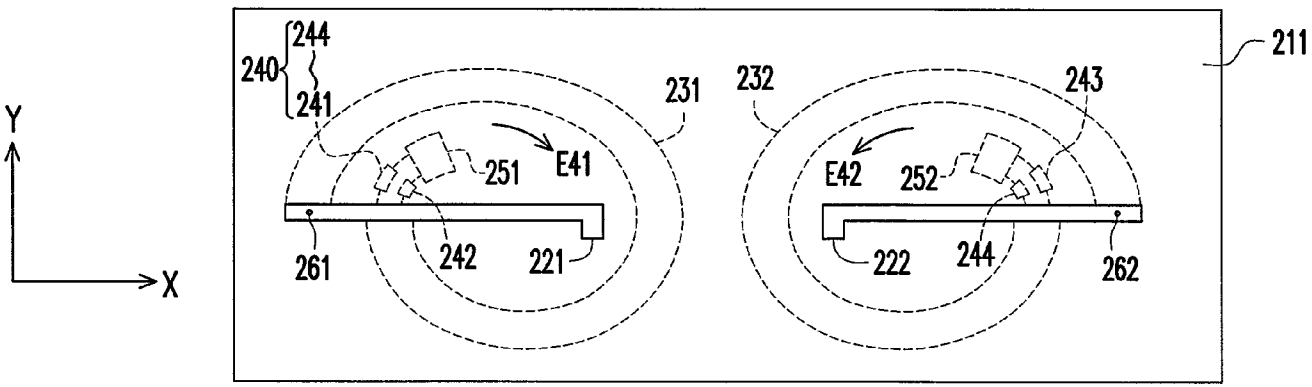

The first microstrip line 231 and the second microstrip line 232 illustrated in FIG. 3 and FIG. 4 are both spirally extended outwards along the two opposite rotation trails. However, in actual applications, the first microstrip line 231 and the second microstrip line 232 may also be spirally extended inwards along the two opposite rotation trails. FIG. 5 and FIG. 6 are respectively a perspective view of a planar antenna with an isotropic radiation pattern on a vertical projection plane according to yet another embodiment of the present invention.

As shown in FIG. 5 and FIG. 6, the first microstrip line 231 is spirally extended inwards from the end of the first radiating body 221 along a clockwise rotation trail and surrounds the first radiating body 221. On the other hand, the second microstrip line 232 is spirally extended inwards from the end of the second radiating body 222 along an anticlockwise rotation trail and surrounds the second radiating body 222.

Besides, along with the change in the surrounding pattern of first microstrip line 231 and the second microstrip line 232, the channel selection element 240, the first line 251, and the second line 252 are disposed close to the inner edges of the first microstrip line 231 and the second microstrip line 232 along a first extension direction E41 and a second extension direction E42. Moreover, the difference between FIG. 5 and FIG. 6 is that the first radiating body 221 and the second radiating body 222 in FIG. 5 exceed the vertical projection range of the first microstrip line 231 and the second microstrip line 232, while the first radiating body 221 and the second radiating body 222 in FIG. 6 do not exceed the vertical projection range of the first microstrip line 231 and the second microstrip line 232.

To be specific, the first microstrip lines 231 and the second microstrip lines 232 illustrated in FIGS. 3~6 are respectively extended along clockwise and anticlockwise rotation trails. However, in actual applications, the rotation trails of the first microstrip line 231 and the second microstrip line 232 can be interchanged as long as the two rotation trails are opposite to each other.

Figure 7:
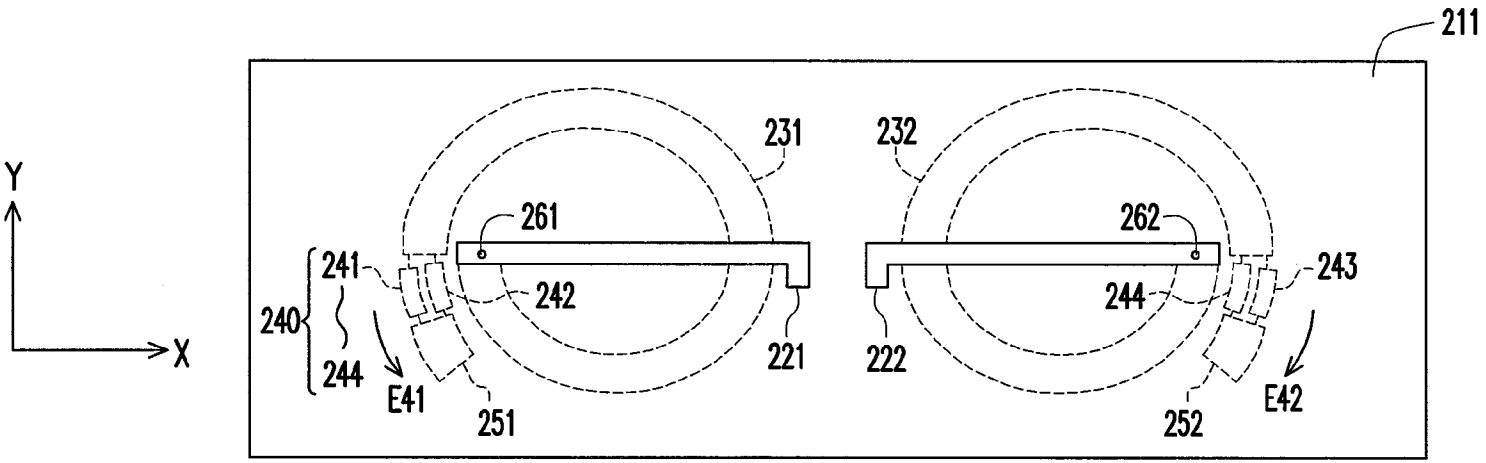
FIG. 7 and FIG. 8 are respectively a perspective view of a planar antenna with an isotropic radiation pattern on a vertical projection plane according to still another embodiment of the present invention.
Figure 8:
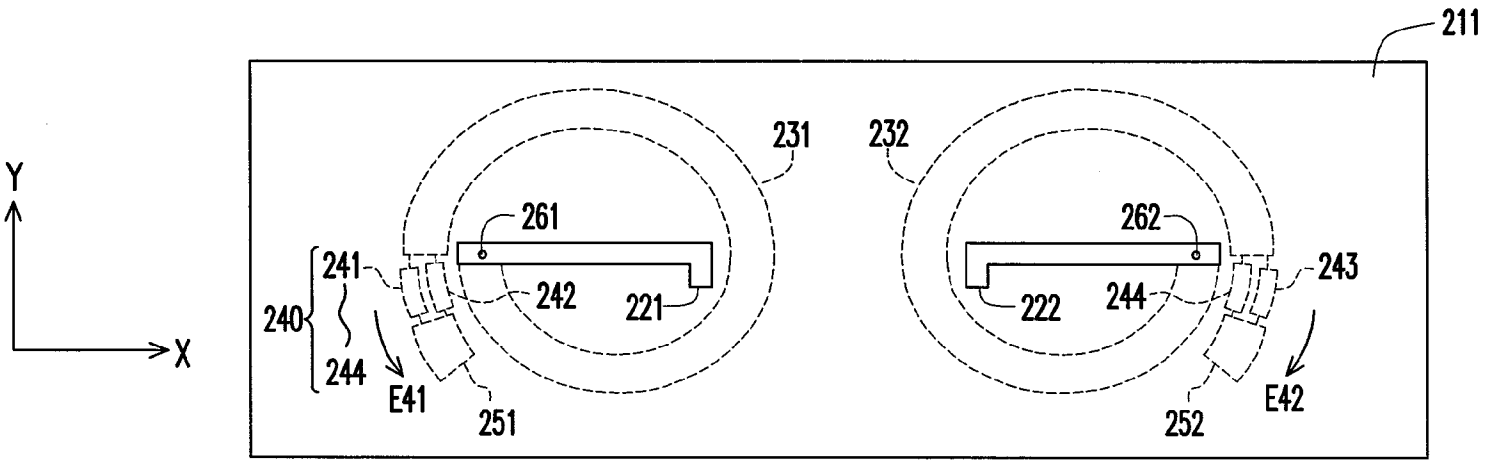

FIG. 7 and FIG. 8 are respectively a perspective view of a planar antenna with an isotropic radiation pattern on a vertical projection plane according to still another embodiment of the present invention. As shown in FIG. 7 and FIG. 8, the first microstrip line 231 is spirally extended outwards from the end of the first radiating body 221 along an anticlockwise rotation trail and surrounds the first radiating body 221. On the other hand, the second microstrip line 232 is spirally extended outwards from the bottom of the second radiating body 222 along the clockwise rotation trail and surrounds the second radiating body 222.

In addition, with the outward surrounding pattern of the first microstrip line 231 and the second microstrip line 232, the channel selection element 240, the first line 251, and the second line 252 are disposed close to the outer edges of the first microstrip line 231 and the second microstrip line 232 along the first extension direction E41 and the second extension direction E42. Moreover, the main difference between FIG. 7 and FIG. 8 is that the first radiating body 221 and the second radiating body 222 in FIG. 7 exceed the vertical projection range of the first microstrip line 231 and the second microstrip line 232 while the first radiating body 221 and the second radiating body 222 in FIG. 8 do not exceed the vertical projection range of the first microstrip line 231 and the second microstrip line 232.

Figure 9:
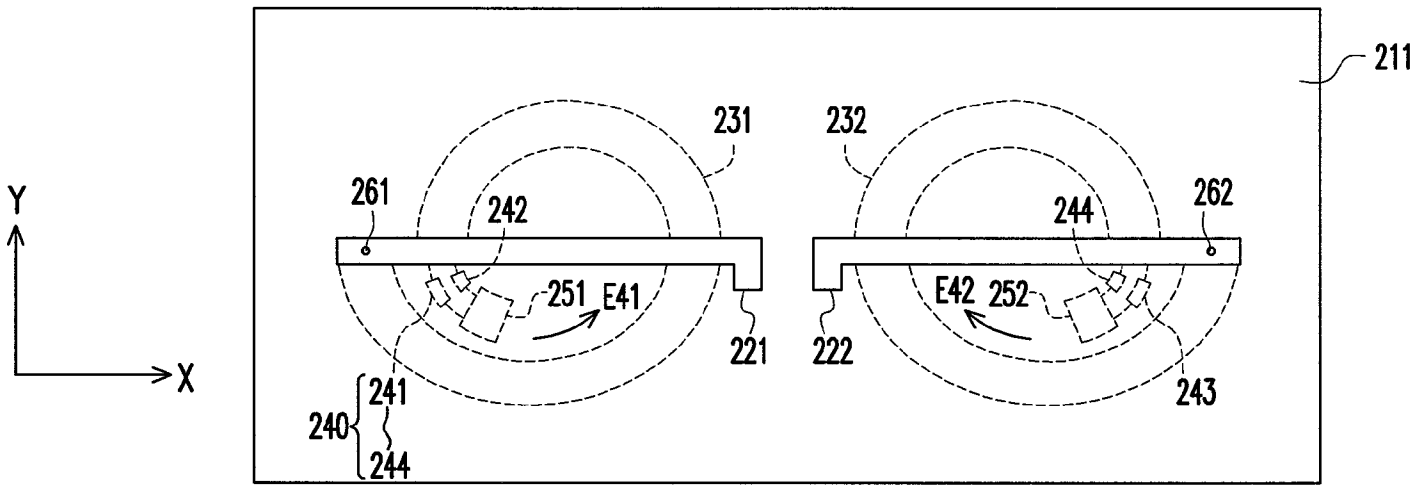
FIG. 9 and FIG. 10 are respectively a perspective view of a planar antenna with an isotropic radiation pattern on a vertical projection plane according to yet still another embodiment of the present invention.
Figure 10:
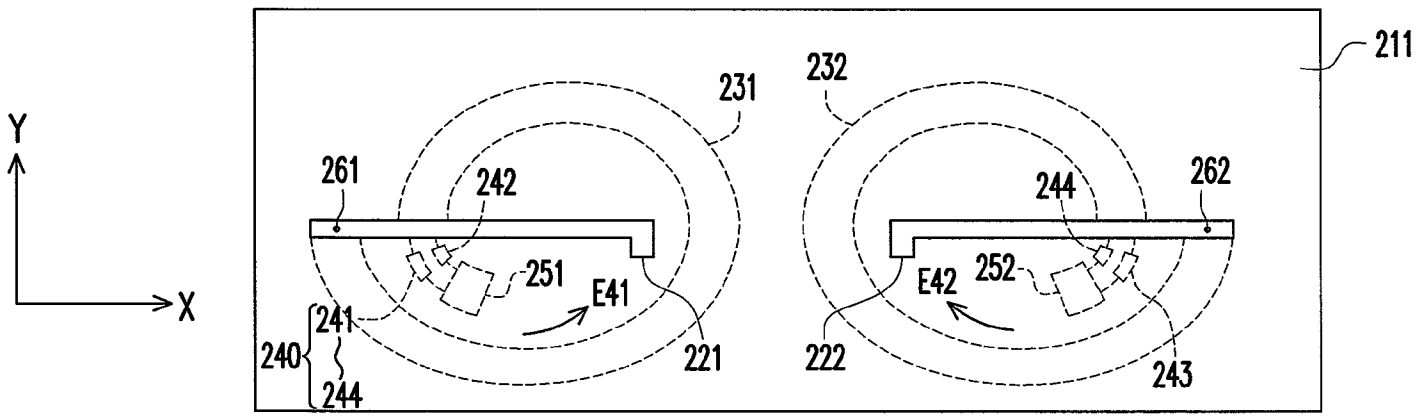

FIG. 9 and FIG. 10 are respectively a perspective view of a planar antenna with an isotropic radiation pattern on a vertical projection plane according to yet still another embodiment of the present invention. As shown in FIG. 9 and FIG. 10, the first microstrip line 231 is spirally extended inwards from the end of the first radiating body 221 along an anticlockwise rotation trail and surrounds the first radiating body 221. On the other hand, the second microstrip line 232 is spirally extended inwards from the end of the second radiating body 222 along a clockwise rotation trail and surrounds the second radiating body 222.

In addition, with the inward surrounding pattern of the first microstrip line 231 and the second microstrip line 232, the channel selection element 240, the first line 251, and the second line 252 are disposed close to the inner edges of the first microstrip line 231 and the second microstrip line 232 along the first extension direction E41 and the second extension direction E42. Moreover, the main difference between FIG. 9 and FIG. 10 is that the first radiating body 221 and the second radiating body 222 in FIG. 9 exceed the vertical projection range of the first microstrip line 231 and the second microstrip line 232 while the first radiating body 221 and the second radiating body 222 in FIG. 10 do not exceed the vertical projection range of the first microstrip line 231 and the second microstrip line 232.

As described above, in the present invention, a pair of in-phase magnetic dipoles is formed by using a microstrip line set spirally extended along two opposite rotation trails, and an isotropic radiation pattern is achieved by the radiation combination from the magnetic dipoles and an electric dipole produced by a dipole antenna. In addition, in the present invention, a high-frequency path is formed by a microstrip line set and a dipole antenna that are electrically connected with each other, and by controlling the on/off state of a channel selection element, a plurality of high-frequency paths and low-frequency paths having different operating frequencies is generated when the dipole antenna is connected to a first line and a second line. Moreover, the present invention relates to an improved structure of a planar antenna, wherein wireless signals from and to all directions can be received and transmitted by the planar antenna so that the signal communication performance of a cell phone can be improved and any communication dead angle is eliminated. Furthermore, due to the flat structure of the planar antenna in the present invention, the cost of a cell phone using the planar antenna is reduced, the robustness of the planar antenna is increased, and the planar antenna can be easily integrated with other electronic parts or circuits (for example, a radio frequency (RF) circuit) to be assembled into a cell phone.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A planar antenna with an isotropic radiation pattern, comprising:

a substrate, having a first surface and a second surface;

a dipole antenna, disposed on the first surface, and having a first radiating body and a second radiating body;

a microstrip line set, disposed on the second surface and electrically connected to the dipole antenna, wherein a first microstrip line and a second microstrip line of the microstrip line set are spirally extended along two opposite rotation trails on a vertical projection plane respectively with ends of the first radiating body and the second radiating body as starting points, so as to form a high-frequency path with the dipole antenna; and a channel selection element, disposed on the second surface and electrically connected to the microstrip line set, wherein a low-frequency path is formed when the first radiating body is connected to a first line and the second radiating body is connected to a second line, wherein a plurality of channels having different operating frequencies is respectively generated within the high-frequency path and the low-frequency path.

2. The planar antenna with the isotropic radiation pattern according to claim 1, wherein the channel selection element comprises:

a plurality of first channel units, electrically connected between the first microstrip line and the first line; and a plurality of second channel units, electrically connected between the second microstrip line and the second line, wherein the channel selection element has different operating frequencies and switches to one of the channels within the high-frequency path and the low-frequency path according to on/off states of the first channel units and the second channel units.

3. The planar antenna with the isotropic radiation pattern according to claim 2, wherein each of the first channel units comprises:

a first switch, having a first end electrically connected to the first microstrip line; and a first inductor, having a first end electrically connected to a second end of the first switch and a second end of the first inductor electrically connected to the first line.

4. The planar antenna with the isotropic radiation pattern according to claim 3, wherein the first switch and the first inductor of the first channel units are connected with each other in series along a first extension direction of the first micro strip line, and the first channel units are arranged in parallel along the first extension direction.

5. The planar antenna with the isotropic radiation pattern according to claim 4, wherein the first line is connected with the first channel units in series along the first extension direction.

6. The planar antenna with the isotropic radiation pattern according to claim 2, wherein each of the second channel units comprises:

a second switch, having a first end electrically connected to the second microstrip line; and a second inductor, having a first end electrically connected to a second end of the second switch and a second end of the second inductor electrically connected to the second line.

7. The planar antenna with the isotropic radiation pattern according to claim 6, wherein the second switch and the second inductor of the second channel units are connected with each other in series along a second extension direction of the second microstrip line, and the second channel units are arranged in parallel along the second extension direction.

8. The planar antenna with the isotropic radiation pattern according to claim 7, wherein the second line is connected with the second channel units in series along the second extension direction.

9. The planar antenna with the isotropic radiation pattern according to claim 2, wherein the first radiating body, the first microstrip line, the first channel units, and the first line are respectively symmetrical to the second radiating body, the second microstrip line, the second channel units, and the second line.

10. The planar antenna with the isotropic radiation pattern according to claim 1, wherein the first microstrip line and the second microstrip line are spirally extended inwards or outwards respectively along the two opposite rotation trails on the vertical projection plane, so as to surround the first radiating body and the second radiating body.

11. The planar antenna with the isotropic radiation pattern according to claim 1, wherein the two rotation trails comprise a clockwise rotation trail and a counterclockwise rotation trail.

12. The planar antenna with the isotropic radiation pattern according to claim 1, wherein the first radiating body and the second radiating body do not exceed a vertical projection range of the first microstrip line and the second microstrip line.

13. The planar antenna with the isotropic radiation pattern according to claim 1, wherein the first radiating body and the second radiating body exceed a vertical projection range of the first microstrip line and the second microstrip line.

* * * * *